United States Patent [19]

Kalayjian

[11] Patent Number: 4,470,363

[45] Date of Patent: Sep. 11, 1984

[54] CABLE OPERATED STEERING SYSTEM

[75] Inventor: Roland D. Kalayjian, Villa Park, Calif.

[73] Assignee: Teleflex Incorporated, Limerick, Pa.

[21] Appl. No.: 410,630

[22] Filed: Aug. 23, 1982

[51] Int. Cl.[3] ..... B63H 25/10

[52] U.S. Cl. ..... 114/144 R; 114/160; 254/396; 242/157 R; 74/89.22

[58] Field of Search ..... 114/144 R, 146, 163, 114/128, 160, 101, 181, 204, 205; 254/390, 391, 400, 413, 396–398, 394; 74/89.22, 484 R, 480 B, 510; 242/157 R

[56] References Cited

U.S. PATENT DOCUMENTS

| | | | |
|---|---|---|---|
| 610,485 | 9/1898 | Hammond | 114/160 |
| 618,607 | 1/1899 | Murray | 114/101 |
| 1,537,545 | 5/1925 | Morton | 254/396 |
| 2,497,900 | 2/1950 | Mork et al. | 74/89.22 |
| 3,606,852 | 9/1971 | Cafiero | 114/163 |
| 4,040,375 | 8/1977 | Atkins et al. | 114/144 R |
| 4,387,658 | 6/1983 | Elliott | 114/144 R |

FOREIGN PATENT DOCUMENTS

| | | | |
|---|---|---|---|
| 2795 | of 1859 | United Kingdom | 114/160 |
| 426385 | 4/1935 | United Kingdom | 114/160 |

*Primary Examiner*—Trygve M. Blix
*Assistant Examiner*—Patrick W. Young
*Attorney, Agent, or Firm*—Reising, Ethington, Barnard, Perry & Milton

[57] ABSTRACT

A boat steering assembly including a pedestal steering actuator for actuating steering movement, a rudder having a steering axis, and cables for transmitting steering movement from the pedestal steering actuator to the rudder. The assembly further includes an idler plate sheave assembly for guiding the cables from the pedestal steering actuator in a substantially vertical orientation to the rudder in a substantially horizontal orientation. The idler sheave assembly is mounted on bolts by adjustable nuts for adjustingly angulating the idler sheave assembly in relation to the rudder to guide the cables leading from the idler sheave assembly in a plane perpendicular to the steering axis of the rudder.

6 Claims, 4 Drawing Figures

CABLE OPERATED STEERING SYSTEM

TECHNICAL FIELD

This invention relates to a steering system for a boat, such as a sailboat. More particularly, the instant invention relates to a pedestal steering system for a sailboat which includes a pedestal mounted wheel connected through a cable and pulley arrangement to a rudder post.

BACKGROUND ART

Pedestal steerers for sailboats and the like generally comprise an upstanding pedestal anchored to the cockpit floor or sole of the boat and enclose a cable drive and pulley mechanism for transmitting rotary movement of the steering wheel into rotary movement of the rudder for steering purposes. Several problems have been presented with steering systems of this type. First, the lapping sheaves over which the cable is entrained as it leaves the pedestal often take up an inordinate amount of space below the cockpit sole. Accordingly, this type of steering system may not be used in those situations where bunks or equipment are disposed underneath the cockpit sole so as not to be in interfering relation to the lapping sheaves. Second, a system of this type often is not usable at all unless the rudder post is disposed vertical to the horizontal or water line because it is impossible to lead the drive cables with the proper lead onto the driven disc connected to the rudder. Thirdly, in systems of this type, the cable of the system must be routed in various ways, often around quite a number of auxiliary pulleys in order to connect the cable ends to the disc associated with the rudder in the proper fashion. Finally, it takes a great amount of time to install the system on the sailboat.

An example of such a prior art steering system is disclosed in the U.S. Pat. No. 4,040,375 to Atkins et al. The Atkins et al patent discloses a preassembled cable directing mechanism which independently changes the direction of the operating cables extending from the steering mechanism of the boat to the rudder disc drive of the rudder. The assembly includes a base plate having adjustably mounted thereon a pair of independently adjustable pulleys or sheaves. However, the Atkins et al patent does not disclose a steering system which is angularly adjustable for disposing the cables from the horizontal sheaves in a proper plane to properly lead the cables to the drive disc wherein the drive disc is not on the horizontal plane. Additionally, the Atkins et al patent does not disclose a steering system which includes vertical idler sheaves and horizontal idler sheaves wherein the vertical idler sheaves are lapped and angularly oriented to align the lead cables onto the horizontal sheaves. Finally, the Atkins et al patent is most effective where the rudder post is located at a relatively short distance from the steering wheel. The instant invention solves the aforementioned problems by providing means for adjusting the pulley system so as not to require a vertically disposed rudder. Additionally, the instant invention may be manufactured at the factory and shipped to the distributor for installation with an absolute minimum amount of time being required for the installation operation.

STATEMENT OF INVENTION

According to the present invention, there is provided a boat steering system including steering actuation means for actuating steering movement, a rudder having a steering axis, and cable means for transmitting steering movement from the steering actuation means to the rudder. The system further includes pulley means for guiding the cable means from the steering means in a substantially vertical orientation to the rudder in a substantially horizontal orientation, the pulley means including adjustment means for adjustably angulating the pulley means in relation to the rudder to guide the cable means leading from the pulley means in a plane perpendicular to the steering axis of the rudder.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
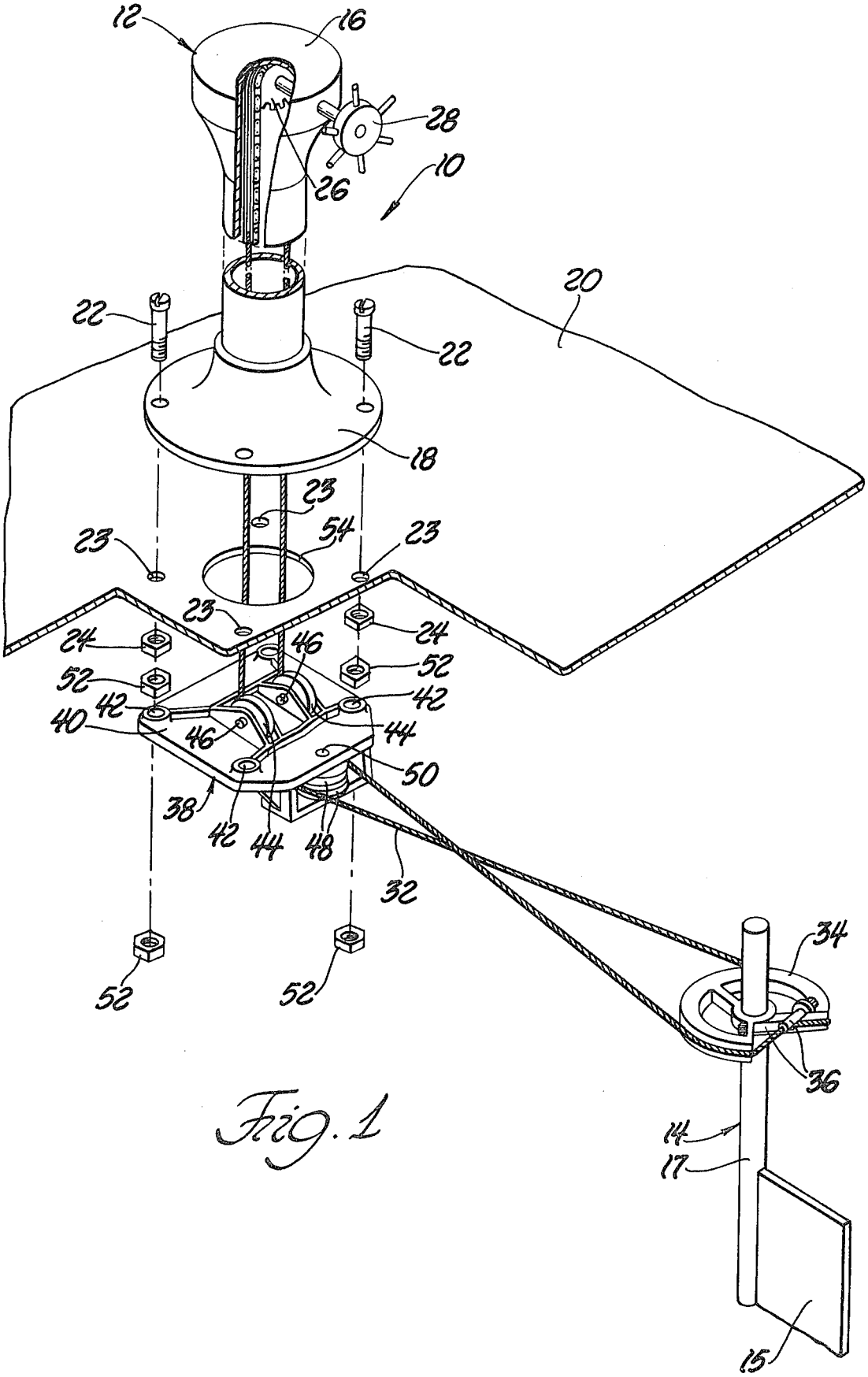
FIG. 1 is an exploded perspective view of a boat steering system constructed in accordance with the instant invention.
Figure 3:
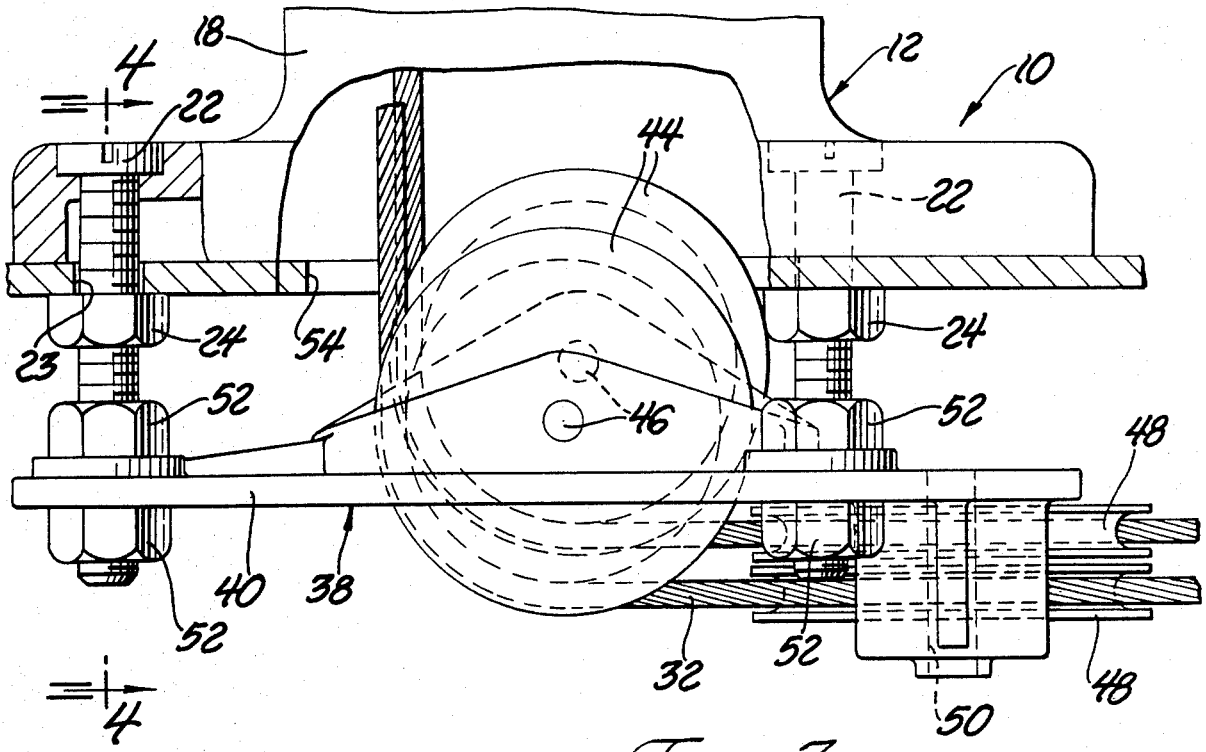
FIG. 3 is a view taken substantially along lines 3—3 of FIG. 2.

Referring to the drawings, a boat steering system is generally shown at 10. The system 10 includes steering actuation means indicated generally at 12 for actuating steering movement of a rudder generally indicated at 14. The rudder 14 includes a fin 15 mounted on a shaft 17, the shaft 17 defining a steering axis. The steering actuation means 12 includes a pedestal 16 having a base portion 18 connected flush with the cockpit sole 20 by a plurality of bolts 22 extending through openings 23 in the cockpit sole 20, as shown in FIGS. 1 and 3. The bolts 22 are fixedly secured to the cockpit sole 20 by nuts 24. The pedestal 16 encloses a drive sprocket 26 adapted to be rotated by the steering wheel 28, as shown in FIG. 1. A chain 30 is entrained about the drive sprocket 26.

The system 10 includes cable means 32 for transmitting steering movement from the steering actuation means 12 to the rudder 14. The cable means includes a cord 32 extending from each end of the chain 30 and having an end portion connected to a drive disc 34, the drive disc 34 being fixedly mounted on the shaft 17 of the rudder 14 for rotation with the rudder 14 about the steering axis. Stakes 36 are fixedly secured to the end portion of the cord 32 and are mounted on the drive disc 34 so as to entrain a portion of each cord 32 about the arcuate portion of the drive disc 34. Thusly, rotational movement of the steering wheel 28 is translated into linear movement of the cord 32 and simultaneously the linear motion of the cord 32 is translated into rotary motion of the rudder 14 via the drive disc 34.

Figure 2:
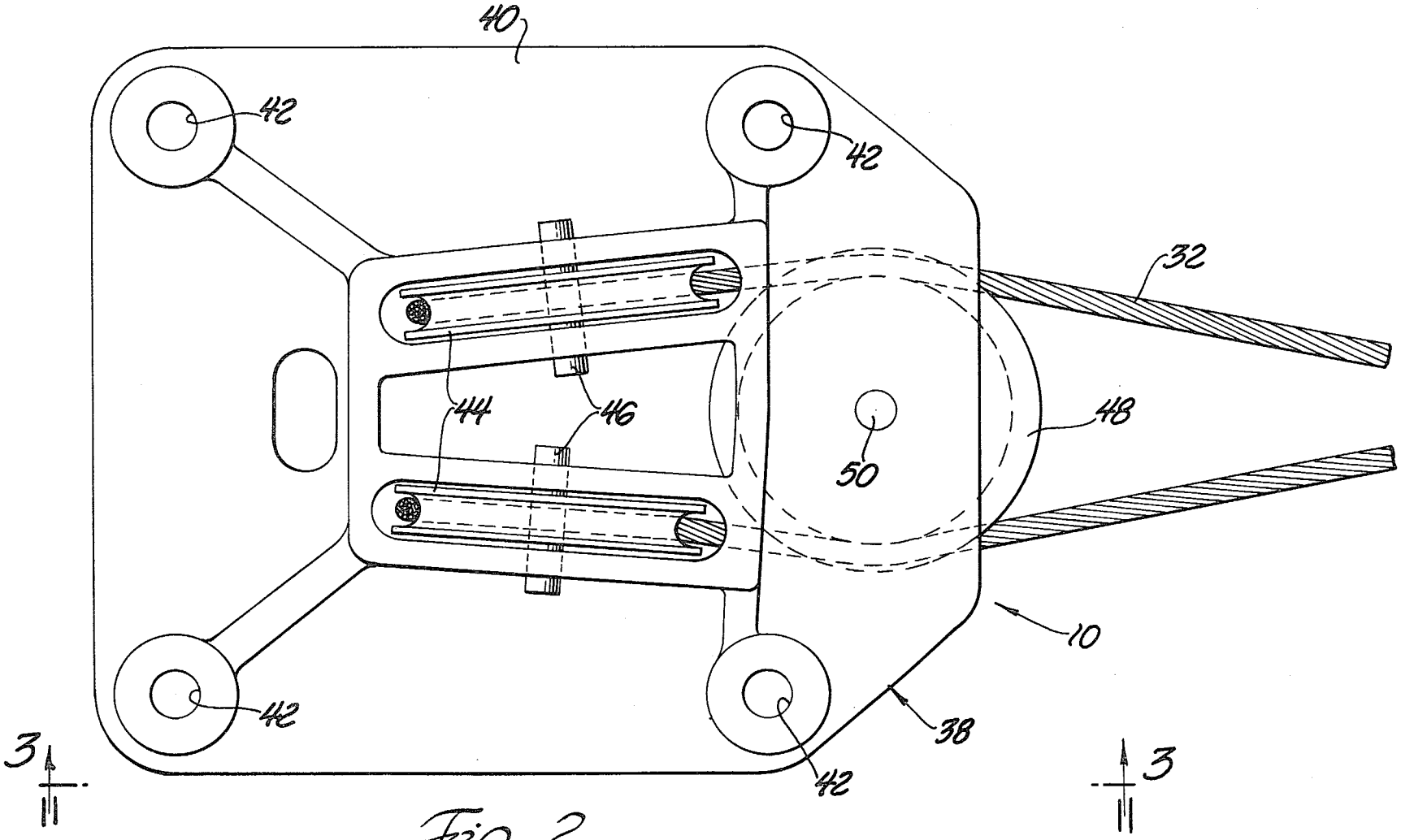
FIG. 2 is a plan view of the pulley means of the instant invention.
Figure 4:
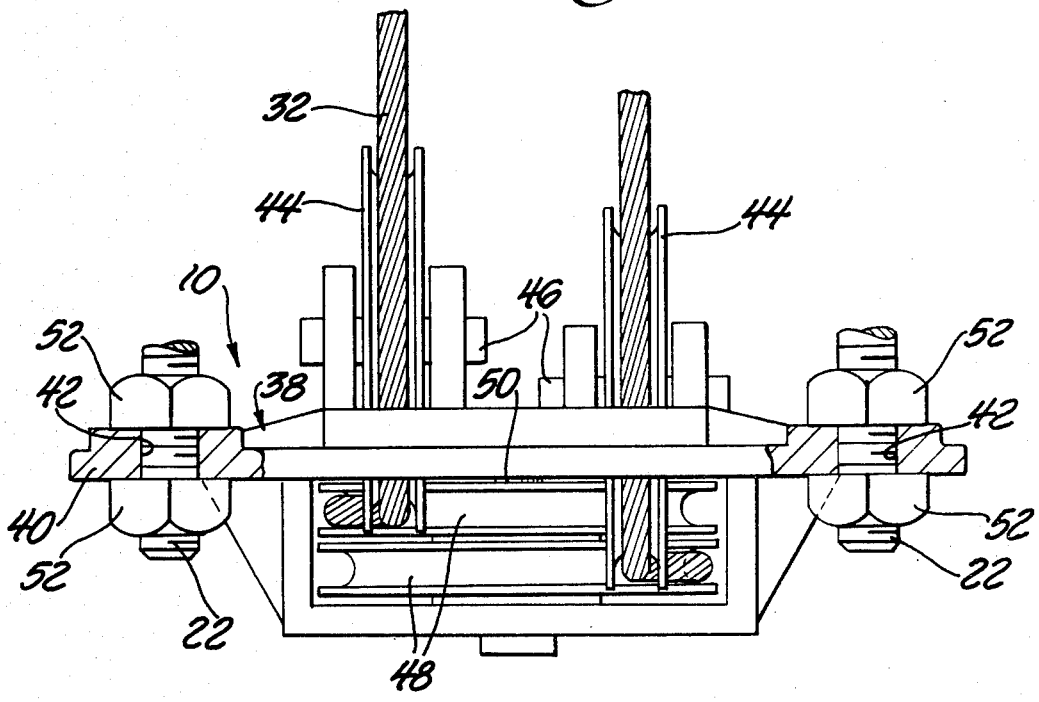
FIG. 4 is a cross-sectional view taken substantially along lines 4—4 of FIG. 3.

The system 10 further includes pulley means generally indicated at 38 for guiding the cords 32 from the steering actuation means 12 in a substantially vertical orientation to the rudder 14 in a substantially horizontal orientation. In other words, the cords 32 lead from the chain 30 through the pedestal 16 in a substantially vertical orientation. The pulley means 38 guide the cords 32 from the vertical orientation to a substantially horizontal orientation so as to lead the cables 32 to the drive disc 34 of the rudder 14. The pulley means 38 includes an idler plate sheave assembly including a generally rectangular idler plate 40 having four spaced openings 42 for receiving the mounting bolts 22. The pulley means 38 further includes a first pair of identical vertically disposed sheaves 44 pivotally connected to the mounting plate 40 on axles 46. The vertically disposed sheaves 44 are vertically lapped relative to each other as shown in FIGS. 3 and 4 and are angularly oriented as shown in FIG. 2. The pulley means 38 further includes a second pair of horizontally disposed sheaves 48 mounted on an axle 50 for rotation on the mounting plate for independent rotation of each other about a common axis defined by the axle 50. The sheaves 44 are vertically lapped relative to each other and angularly oriented in such a way that the cord 32 coming from each of the sheaves 44 is properly aligned for leading onto the respective horizontal sheaves 48.

The instant invention is characterized by the pulley means 38 including adjustment means for adjustably angulating the pulley means 38 in relation to the rudder 14 to guide the cord 32 leading from the pulley means 38 in a plane perpendicular to the steering axis of the rudder 14. More specifically, the adjustment means includes the plurality of bolts 22 which mount the mounting plate 40 below the cockpit sole 20 and a plurality of adjustable nuts 52 for positioning the mounting plate 40 on the bolts 22 on a plane perpendicular to the steering axis of the rudder 14. In other words, the bolts 22 pass through the openings in the mounting plate 40 and the adjusting nuts 52 adjustably secure the mounting plate 40 to the bolts 22. The nuts 52 are adjusted to dispose the cord 32 leading from the horizontal sheaves 48 in the proper plane so as to properly lead onto the disc drive 34 for connection thereto. In this way, the pedestal steering assembly 12 can be utilized in a sailboat having a rudder 14 wherein the rudder 14 has a steering axis offset from the vertical. The adjustment means comprising the bolts 22 and adjustable nuts 52 angulate the plane of the cord 32 leading from the horizontal pulleys 48 so as to be in a plane perpendicular to the steering axis of the rudder 14 thereby properly leading onto the arcuate portion of the drive disc 34.

The instant invention provides significant advantages over the prior art. More specifically, the vertically lapping sheaves 44 and the horizontal sheaves 48 can be prelocated at the factory so as to be in predetermined positions with respect to each other to automatically result in the cord 32 being entrained with the proper lead of the cord 32 therebetween. To install the pulley means 38 on the cockpit sole 20, it is only necessary to provide a cutout opening 54 disposed between the bolt openings 23 in the cockpit sole 20. The pulley means 38 is mounted on the mounting bolts 22 using the adjusting nuts 52 to lead the cords 32 onto the drive disc 34. Alternatively, the pulley means 38 may be mounted on other bolts disposed below the pedestal assembly 12 while properly orienting the vertically disposed sheaves 44 relative to the vertically extending portions of the cord 32. The assembly saves space since the vertical sheaves 44 can be recessed within the cockpit sole 20 and in some installations, the vertically disposed sheaves 44 will extend upwardly into the hollow pedestal base 18. Thus, the assembly minimizes the amount of space required beneath the cockpit sole 20 for mounting the entire system 10.

Secondly, since the sheaves 44 and 48 of the system 10 are disposed in their predetermined position at the factory, the instant invention may be shipped to a distributor for immediate installation on a boat without cutting cord to certain lengths, routing them through various paths, utilizing other idler pulley assemblies for routing purposes, applying clamps to the cords for making connections to the drive disc 34, and other such previously required steps. A manufacturer may ship the instant invention to a distributor and the assemblies may be immediately fitted onto the cockpit sole 20 of a boat whereby the only steps required are the mounting of the pulley means 38 and the connecting of the stakes 36 to the drive disc 34. In this regard, the exact amount of cord 32 is provided in the assembly 10 for a particular boat installation.

Thirdly, the instant invention accommodates boats having rudder posts 17 disposed at an angle to the vertical. Prior art disc drives have been usable primarily only with rudder posts which were mounted vertically because of the difficulty of disposing the drive cord 32 at the proper lead angle to lead onto the arcuate surface of the drive disc 34. Since the pulley means 38 of the instant invention is one unit having the sheaves 44 and 48 in a preoriented position relative to each other, the mounting plate 40 is adjusted on the mounting bolts 22 to accommodate the angle of the rudder post 17 which may be disposed away from the vertical.

Finally, in the prior art, there has been an extreme limitation as to the distance between the axis of the pedestal 16 and the axis of the rudder shaft 17. In other words, if the pedestal was located somewhat too close or too far from the axis of the rudder post 17, the drive disc assembly could not be used. The instant invention provides pulley means 38 having virtually no limitation as to the space which may be utilized between the pedestal 16 and rudder 14.

The instant invention has been described in an illustrative manner and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are not to be in any way limiting, the invention may be practiced otherwise than is specifically described.

The embodiments of the invention in which an exclusive property or privilege is claimed are defined as follows:

1. A steering assembly (10) including a pulley assembly (38) for leading a pair of cables (32) from a steering actuator (12) through a substantially vertical orientation and then through a substantially horizontal orientation to a rudder assembly (14), said pulley assembly (38) comprising:

a mounting plate (40);

a first pair of vertically disposed sheaves (44) rotatably mounted on said mounting plate (40) in a fixed vertical orientation for rotation about horizontal axes; and a second pair of horixontally disposed sheaves (48) mounted for independent rotation on said mounting plate (40) in a fixed horizontal orientation for rotation about vertical axes to lead the cables (32) from said vertically disposed sheaves (44) so that the horizontal reaches at the cables (32) may be disposed at a wide variety of angles relative to one another to cross over each other as the cables (32) lead to any one of a variety of sized and located rudder assemblies (44) said vertically disposed sheaves (44) being lapped relative to each other and angularly oriented with respect to one another.

2. A steering assembly as defined in claim 1 wherein said horizontally disposed sheaves (48) are mounted for rotation about a common axis (50).

3. A steering assembly as defined in claim 2 wherein said mounting plate (40) includes a plurality of spaced openings (42) for receiving mounting bolts (22) therethrough, said mounting plate (40) having one dimension thereacross which is less than the distance between the widest spaced pair of said openings (42).

4. A steering assembly as defined in claim 3 including a hollow pedestal (16) having a base portion (18), said base portion (18) having openings aligned with said openings (42) of said mounting plate (40) for receiving bolts (22) therethrough.

5. A steering assembly as defined in claim 1 wherein the rudder (14) is angulated relative to the horizontal and includes a drive disc (34) fixedly mounted thereon for rotation with the rudder (14) about a steering axis, said pulley assembly (38) including adjustment means for adjustably angulating said horizontally disposed sheaves (48) in relation to the rudder (14) to guide the cables (32) over said horizontally disposed sheaves (48) in a plane perpendicular to the steering axis and to entrain the cables (32) over the drive disc (34).

6. A steering assembly as defined in claim 5 wherein said adjustment means includes a plurality of bolts (22) for mounting said mounting plate (40) on a support structure (20) and a plurality of adjustable nuts (52) for positioning said mounting plate (40) on said bolts (22) on the plane perpendicular to the steering axis of said rudder (14).

* * * * *